US005541632A

United States Patent [19]

Khodapanah et al.

[11] Patent Number: 5,541,632

[45] Date of Patent: Jul. 30, 1996

[54] INK PRESSURE REGULATOR FOR A THERMAL INK JET PRINTER

[75] Inventors: Tofigh Khodapanah; George T. Kaplinsky, both of San Diego, Calif.

[73] Assignee: Hewlett-Packard Company, Palo Alto, Calif.

[21] Appl. No.: 302,077

[22] Filed: Sep. 7, 1994

Related U.S. Application Data

[63] Continuation of Ser. No. 928,811, Aug. 12, 1992, abandoned.

[51] Int. Cl.[6] ..... B41J 2/175

[52] U.S. Cl. ..... 347/87

[58] Field of Search ..... 347/86, 87; 138/26, 138/28

[56] References Cited

U.S. PATENT DOCUMENTS

| | | | |
|---|---|---|---|
| 4,412,232 | 10/1983 | Weber et al. | 346/140 R |
| 4,422,084 | 12/1983 | Saito | 346/140 R |
| 4,456,916 | 6/1984 | Kocot | 346/140 R |
| 4,503,443 | 3/1985 | Dagna et al. | 346/140 R |
| 4,992,802 | 2/1991 | Dion et al. | 346/1.1 |
| 5,434,603 | 7/1995 | Hunt | 347/87 |

FOREIGN PATENT DOCUMENTS

| | | |
|---|---|---|
| 0437363 | 7/1991 | European Pat. Off. . |
| 00519664 | 12/1992 | European Pat. Off. . |
| 3131944 | 3/1982 | Germany . |
| 0290544 | 12/1987 | Japan . |

*Primary Examiner*—N. Le

[57] ABSTRACT

An ink pressure regulator for use inside of a flexible ink bag reservoir for a replaceable or refillable ink cartridge comprises a bow spring (60) configured to have substantially linear force/deflection characteristics and a pair of plates (40, 50) which collapse to a substantially flat shape to minimize the amount of ink remaining after printing has depleted the ink from the cartridge. The regulator may be manufactured of one or aplurality of separate pieces.

19 Claims, 5 Drawing Sheets

FIG. 2A
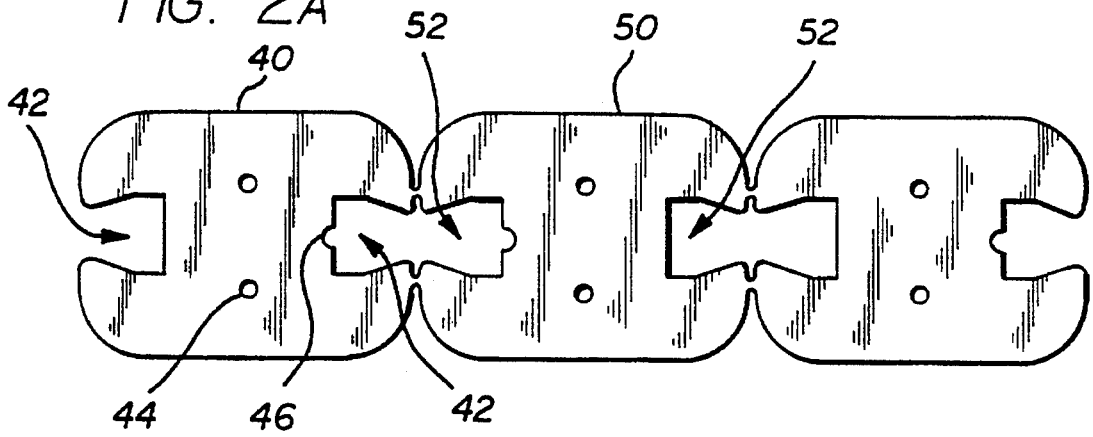
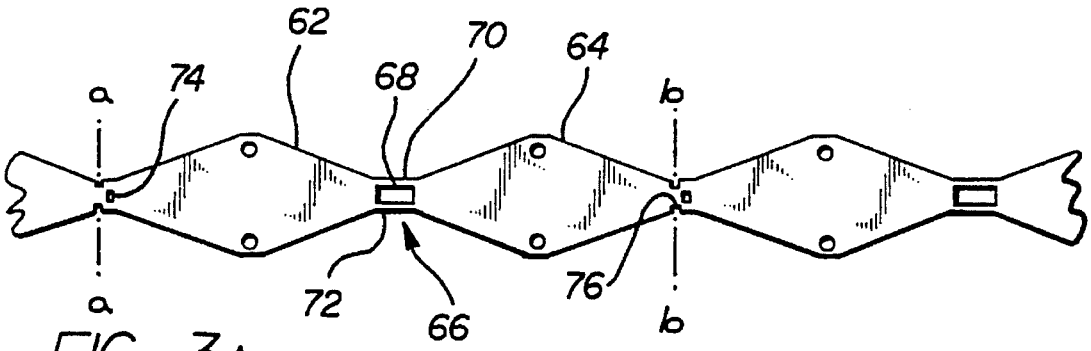
FIG. 3A
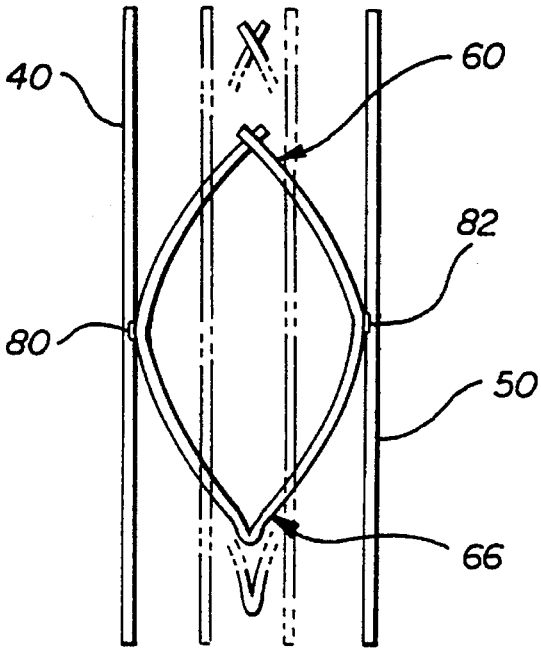
FIG. 4

FIG. 5
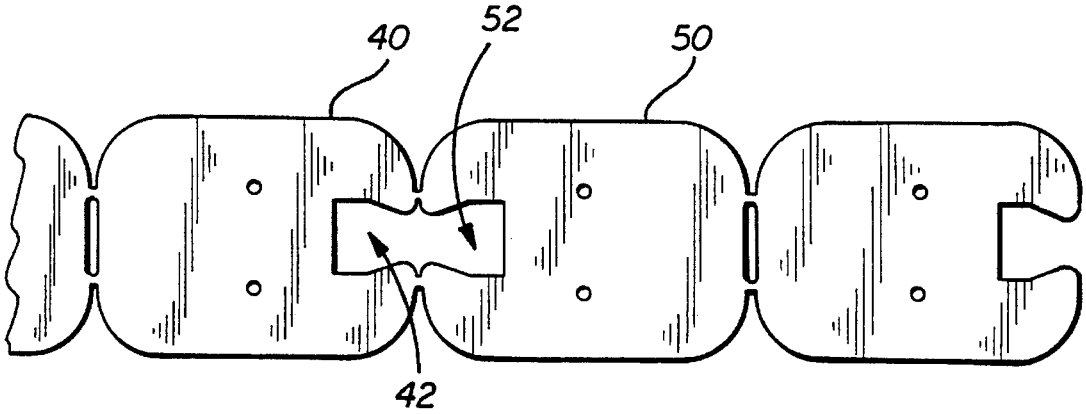
FIG. 6
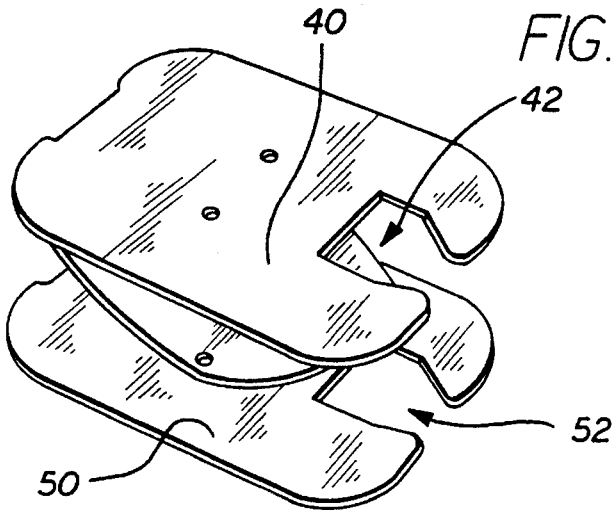
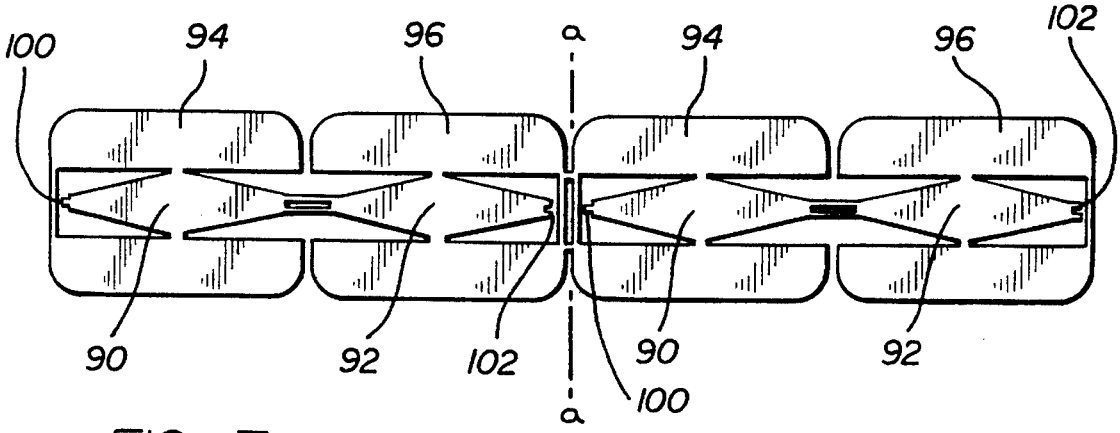
FIG. 7

INK PRESSURE REGULATOR FOR A THERMAL INK JET PRINTER

CROSS REFERENCE TO RELATED APPLICATION(S)

This is a continuation of application Ser. No. 07/928,811 filed on Aug. 12, 1992, now abandoned.

BACKGROUND OF THE INVENTION AND PRIOR ART

The present invention relates generally to ink reservoirs for high speed computer driven inkjet printers and plotters and other applications where precise pattern dispensation of a fluid is required such as the layout of circuit masks. In such printers the ink reservoir is ordinarily maintained under a sub-atmospheric or negative pressure so that ink will not leak or drool from the printhead. Various types of ink reservoirs may be used including refillable ink reservoir cartridges which are mounted on the moveable printer carriage, throwaway replaceable cartridges which are mounted on the printer carriage and remote or offboard ink reservoirs from which ink is pumped to the print head by tubing. In the onboard refillable or throwaway cartridges, a polymer foam is ordinarily provided in the ink reservoir so that the capillary action of the foam will prevent ink from drooling from the printhead. Polymeric foams of the type typically used for this purpose are nonbiodegradable and thus cause environmental problems whenever a previously used cartridge is emptied and thrown away. In addition, the use of industrial foam in the ink reservoir restricts the operating pressure range of the ink cartridge and such foams ordinarily leave a chemical residue which is incompatible with and/or reacts adversely with printer ink. Similarly, the relatively long tubing used to convey ink from an offboard pressure reservoir to a printing head does not lend itself well for different printing pressure ranges.

A collapsible ink reservoir for an inkjet printer is disclosed in U.S. Pat. No. 4,422,084 issued Dec. 20, 1983 to Saito. Negative pressure is maintained in a polypropylene ink bag by a spring which biases the bag walls apart from each other.

One example of an onboard ink pressure reservoir cartridge is disclosed in U.S. Pat. No. 5,359,353 entitled SPRING-BAG PRINTER INK CARTRIDGE WITH VOLUME INDICATOR filed by David S. Hunt and W. Bruce Reid and assigned to the assignee of the present invention. The cartridge disclosed in that application basically comprises a rectangular housing containing a flexible bag of ink, an ink filter and a printhead which receives ink from the filter. A spring inside of the bag of ink urges its flexible walls apart from each other thus maintaining a negative or sub-atmospheric pressure in the reservoir which is overcome as ink is emitted from the printhead. Cartridges of this type, while well suited for their intended purpose, suffer from the disadvantage that ink is not always completely used since the spring occupies a certain volume of space inside of the ink bag. As seen in that application, the spring essentially consists of a pair of spaced parallel plates which are urged apart by a spring.

Also of interest are U.S. patent applications owned by the assignee of the present invention and currently identified by U.S. Ser. No. 08/240,297 filed May 9, 1994 titled COLLAPSIBLE FILM-BAG/FRAME and U.S. Ser. No. 07/995,851 filed Dec. 23, 1992 titled INK DELIVERY SYSTEM, both of which have been filed on the same day as the present applicaton and the disclosures of which are hereby incorporated by reference.

SUMMARY OF THE INVENTION

The present invention provides a pressure regulator for a liquid ink cartridge having an ink reservoir to be maintained under negative pressure, said regulator comprising:

a) a pair of spaced side plates respectively engageable with moveable walls of said reservoir; and b) a bow spring having a bight disposed between said plates and urging said plates apart from each other.

The present invention further provides a thermal ink jet printer ink cartridge comprising a rigid housing containing an ink reservoir to be maintained under negative pressure, said reservoir having at least one flexible wall, a thermal ink jet print head in fluid communication with the interior of said reservoir and an ink pressure regulator in said ink reservoir, said regulator comprising:

a) a pair of spaced substantially parallel flat side plates respectively engageable with said flexible wall of said reservoir; and b) a bow spring having a pair of opposed bights disposed between said plates and urging said plates apart from each other.

BRIEF DESCRIPTION OF THE DRAWINGS

FIGS. 2A and 2B are plan views of two embodiments of a continuous metal strip of plates which are intended to be severed from each other to form individual side plates for a first embodiment of a pressure regulator.

FIGS. 3A and 3B are plan views of two embodiments of a continuous strip of metal segments which are intended to be cut apart to form bow springs for use with the plates of FIG. 2.

FIG. 4 is a side view of a pressure regulator comprised of a pair of side plates and bow springs.

FIG. 5 is a plan view of second embodiment of a continuous strip of metal plates like FIG. 2.

FIG. 6 is a perspective view of a modified pressure regulator having the side plates of FIG. 5.

FIG. 7 is a plan view of a continuous metal strip configured to form a pressure regulator comprised of spaced plates and a bow spring therebetween from a single piece of metal.

DESCRIPTION OF THE PREFERRED EMBODIMENT

Figure 1:
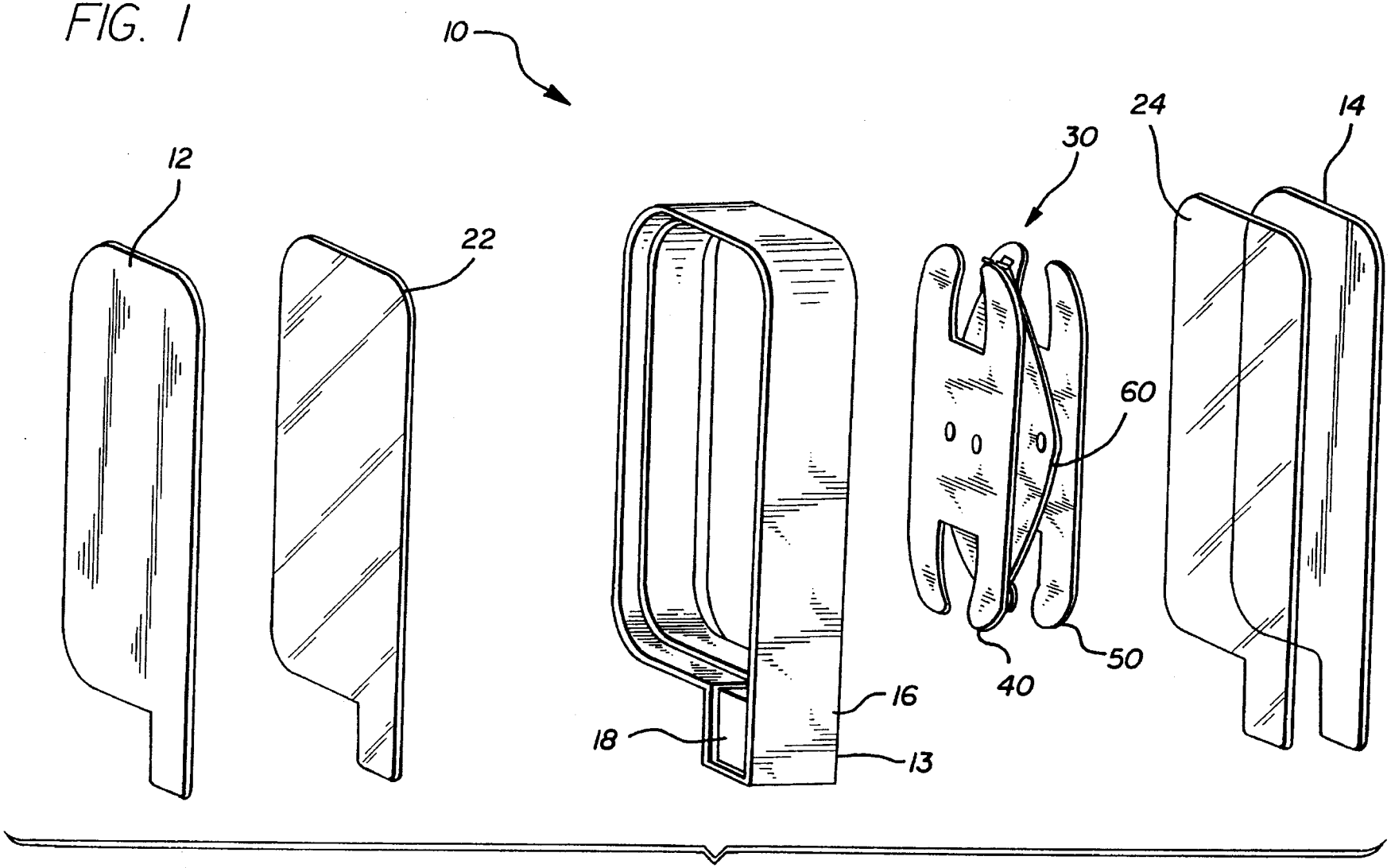
FIG. 1 is an exploded perspective view of a replaceable or throwaway ink cartridge for a thermal inkjet printer.

The replaceable ink cartridge in which the present invention is used is seen in FIG. 1 to comprise a rigid housing 10 having a pair of spaced cover plates 12, 14 intended to be affixed as by cementing to opposite sides of a plastic peripheral wall section 16. Snout portion 13 of the cartridge has an ink discharge aperture in its lowermost end wall (as seen in FIG. 1) to which is affixed an electrically driven print head, not shown.

A flexible ink reservoir bag comprising a pair of membranes 22, 24 which are joined at their peripheral edges to the inside of wall section 16 of the reservoir contains a pressure regulator 30 which in turn is comprised of a pair of spaced parallel plates 40, 50 urged apart by a bow spring 60 into engagement with the flexible reservoir wall membranes 22, 24. The snout portion 13 of housing 10 contains an ink filter 18 which is placed in fluid communication with the flexible bag ink reservoir by suitable porting and has an ink outlet in fluid communication with the printhead.

Figure 2B:
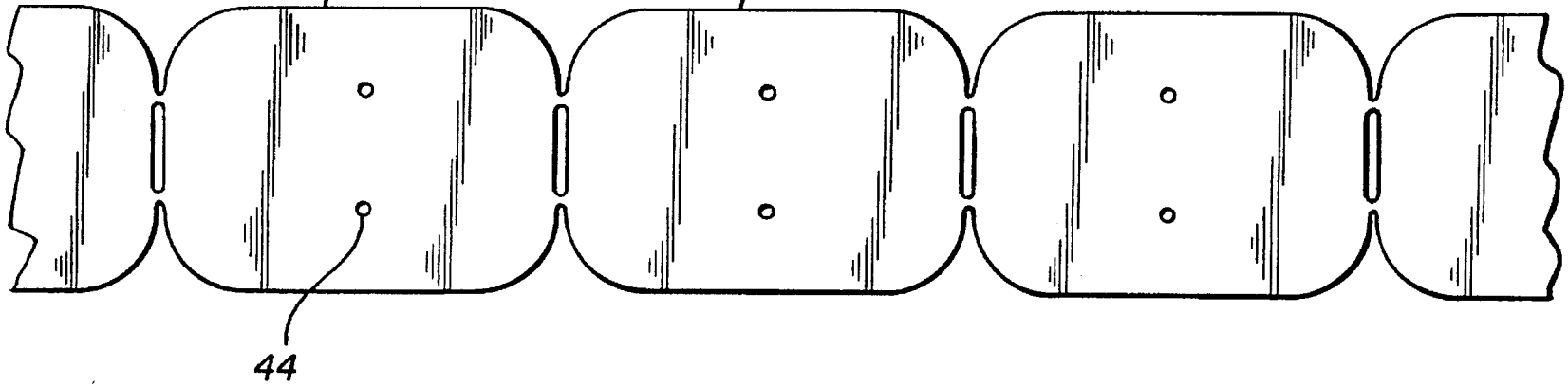

The pressure regulator side plates 40, 50, best seen in FIGS. 2A and 2B, may be individually cut from a continuous metal strip of metal such as stainless steel. In the presently preferred embodiment, each plate is of generally rectangular configuration with rounded corners to avoid damaging the flexible bag membranes. Optionally as seen in FIG. 2A, notches 42, 52 may be provided in the oppositely facing ends of each plate for a purpose to be described. Indexing holes 44 and indicators 46 may be placed in each plate segment to properly position the plates for cutting and tooling.

Figure 3B:
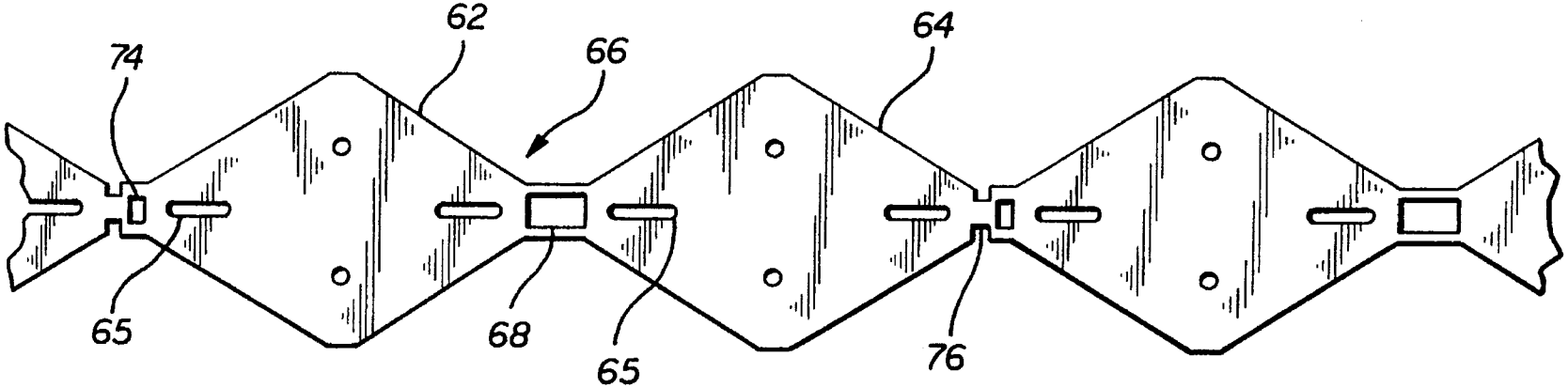

FIGS. 3A and 3B show different embodiments of a strip of individual bow springs 60 which also may conveniently be cut from a common strip of metal. Each bowspring 60 comprises a pair of adjacent diamond shaped segments 62, 64 which is cut from the strip at cutlines aa and bb as seen in FIG. 3A. A junction between the two adjoined generally diamond shaped segments of each bow spring forms a spring hinge 66. Preferably, the spring hinge 66 has a rectangular aperture 68 therein which defines a pair of spaced parallel hinge segments 70, 72.

At one of the ends of the diamond shaped segments which is removed from the hinge, a transverse slot 74 is formed and at the other remote end of the diamond shaped segments a tab 76 is cut of dimensions to be received in the slot 74 when the spring is bent back about the hinge 66 to form a pair of bights 80, 82 (FIG. 4). The embodiment of the spring shown in FIG. 3B has a slightly wider profile than the spring seen in FIG. 3A (the length and width are design choices) and is provided with elongate slots 65 at the locations shown which give the designer an added parameter of control over the final bending characteristics of the spring.

The bow spring 60 is affixed, preferably by spot or laser welding at the apexes of each of its bights 80, 82, centrally onto each of the sideplates 40, 50. The spring 60 in its unstressed condition occupies the solid line configuration of FIG. 4. As the regulator is assembled into an ink cartridge, the regulator is collapsed partially such that it initially occupies a prestressed condition inside the cartridge housing. The amount of this prestressing is readily controllable by the designer by selecting the desired degree of curvature to which the bow spring is bent.

As ink is withdrawn from the reservoir bag, the flexible sidewalls 22, 24 of the bag and the pressure regulator sideplates 40, 50 gradually move towards each other whereby the plates and bow spring occupy the partially collapsed position shown in phantom lines shown in FIG. 4. Further collapse of the spring 60 as the reservoir is evacuated of ink results in the spring occupying an essentially flat condition with the two sideplates 40, 50 coming virtually into contact with each other as the upper interconnected slot 74 and tab 76 ends of the spring move between the opposed apertures 42, 52 in the upper ends of the two spaced sideplates 40, 50. Similarly, the lower hinge end of the spring 60 moves into the space left by the lower apertures 42, 52 in the two opposed sideplates 40, 50 whereby the pressure regulator is allowed to collapse to a substantially flat configuration. In practice, the regulator may have a spring ratio of from about 25:1 to as much as 50:1. This permits the regulator to substantially collapse so that substantially all of the ink in the reservoir may be used before the reservoir is discarded or refilled, as the case may be.

Ideally, both sideplates 40, 50 and the bow spring 60 are made of a non-corrosive sheet metal such as stainless steel. In one embodiment, a spring has been constructed of stainless steel of 6 mils thickness and the sideplates are constructed of Type 301 spring tempered stainless steel of 7 mils thickness having a minimum tensile strength of 220,000 psi and a minimum yield strength of 200,000 psi.

Figure 8:
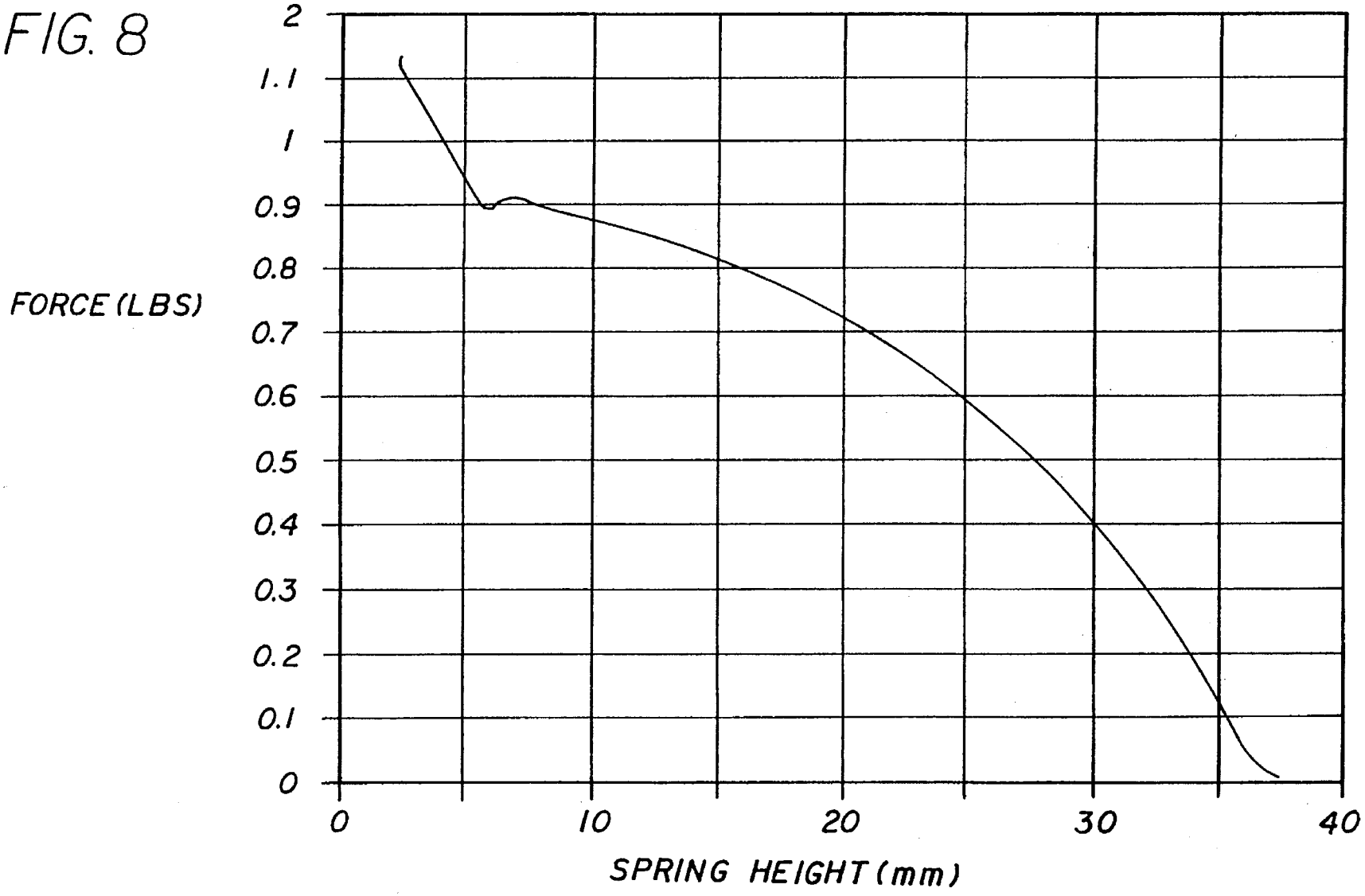
FIG. 8 is a graph plotting force/deflection characteristics of pressure regulator springs constructed according to the teachings of the present invention.

The force/deflection characteristics of the various springs constructed as above described are shown in FIG. 8. In general, springs which require a greater collapsing force produce a higher negative pressure in the ink reservoir bag. The spring collapsing force is readily controllable by varying one or more of (1) the spring thickness, (2) the spring length, (3) the spring width, and (4) the degree of curvature of the spring. The slot 74 and tab 76 connection and the aperture 68 are designed to provide minumal effect on the bending characteristcs of the spring.

FIG. 8 is the result of a plot of a number of tested springs each having the same construction. FIG. 8 shows a curved rather than a linear relationship between spring deflection and deflection force as the spring 60 collapses from an outside width of the sideplates of about 37 mm down to 6 mm. At the end of the range where the spring is substantially collapsed, the curve becomes substantially linear as more force is required to collapse the spring the last few millimeters. However, in the operating range the spring is installed with a prestressed width of about 16 mm and it is seen that the amount of added force required to collapse the spring in the range of from about 16 mm down to about 6 mm actually decreases with increasing deflection. These deflection characteristics are attained primarily by the novel configuration of the spring hinge 66 and diamond or trapezoidal configuration of the spring segments 62, 64. In the manufacturing process, the spring strip is bent to a selected bow or curvature which results in the desired amount of force required to deflect the spring as ink is evacuated from the reservoir. The end result is a substantially complete evacuation of ink from the flexible bag since the pressure regulator typically occupies only about one percent of the full reservoir volume. The trapezoidal or substantially diamond configuration of the spring segments 62, 64 also results in substantially the spring characteristics seen from in FIG. 8. Inspection of FIG. 4 will show that, in the totally collapsed position of the spring, the upper and lower ends of the spring 60 are still disposed slightly inwardly of the upper and lower edges of the sideplates 40, 50 whereby neither the spring hinge 66 nor the coupled slot and tab 74, 76 project outwardly thereof to a position which would be likely to damage the flexible bag walls 22, 24.

FIGS. 5 and 6 show a modified embodiment of the pressure regulator in which each of the sideplates 40, 50 has a notch 42, 52 only in one end thereof. The notchs are positioned to receive the end of the bowspring having the bent spring hinge 66 and provide clearance therefor as the regulator collapses. It has been found that notches at the other ends of the plates to receive the ends of the bowspring which have the slot 74 and tab 76 are not essential since in the completely collapsed condition of the regulator, the slot and tab ends lie adjacent to each other and do not occupy as much space (in the vertical direction as viewed in FIG. 6) as does the bent end of the bowspring where the notches 42, 52 are placed.

If desired, the pressure regulator may be formed from a single piece of metal such as stainless steel as seen in FIG.

7. In this embodiment, individual pressure regulators are formed from a continuous metal strip severed at cut lines a—a with the central diamond shaped spring portions 90, 92 being bent to a curved shape such as seen in FIGS. 1 and 3 and with the rectangular side portions 94, 96 remaining substantially flat to form the sideplates. The ends of the bow spring portions have been provided with appropriate configuration to form a bent hinge 98 at one end of the bow spring and an engageable tab 100 and slot 102 at the other ends of the spring portions 90, 92.

The pressure regulators described herein are easy to fabricate as well as easy to assemble without loss of precise control of the final spring characteristics. Persons skilled in the art will readily appreciate that various modifications can be made from the preferred embodiment thus the scope of protection is intended to be defined only by the limitations of the appended claims.

We claim:

1. A pressure regulator for a liquid ink cartridge having an ink reservoir to be maintained under negative pressure, said reservoir having a pair of walls, at least one of which is moveable with respect to the other wall, said regulator comprising:

a) a pair of spaced substantially parallel flat side plates contacting the respective pair of walls; and b) a bow spring for moving the walls of said reservoir apart from each other to expand the volume of said bag to thereby maintain said ink reservoir under negative pressure, said bow spring having a bight in contact with one of said plates, disposed between said plates and urging said plates apart from each other in substantially parallel planes whereby said plates and said spring occupy an essentially flat configuration as said reservoir is evacuated of ink.

2. The pressure regulator of claim 1, wherein said bow spring has a pair of opposed bights disposed between said plates.

3. The pressure regulator of claim 2, wherein said plates are substantially parallel to each other.

4. The pressure regulator of claim 3, wherein said bow spring is affixed to each of said plates.

5. The pressure regulator of claim 3, wherein said spring is sheet metal.

6. The pressure regulator of claim 5, wherein said spring is comprised of a pair of adjoined generally diamond shaped segments having a junction therebetween which forms a spring hinge.

7. The pressure regulator of claim 6, wherein said spring hinge has an aperture therein which defines a pair of spaced hinge segments.

8. The pressure regulator of claim 7, wherein said aperture is rectangular to define a pair of spaced parallel hinge segments.

9. The pressure regulator of claim 6, wherein said spring has a slot proximate a remote end of one of said pair of diamond shaped segments and has a tab proximate a remote end of the other of said pair of diamond shaped segments, said tab being received in said slot when said spring is bent about said hinge to form said bights.

10. The pressure regulator of claim 9, wherein each of said plates is of generally rectangular configuration and has rounded corners.

11. The pressure regulator of claim 10, wherein said plates each have at least one notch in opposed parallel edges thereof, said notches providing clearance for receiving said adjacent tab and notch ends of said spring as said plates move toward each other.

12. The pressure regulator of claim 11, wherein said plates each have a second notch in said opposed parallel edges thereof opposite said opposed parallel edges, said second notches providing clearance for receiving said hinge as said plates move toward each other.

13. The pressure regulator of claim 10, wherein said spring is stainless steel.

14. The pressure regulator of claim 13, wherein said plates are stainless steel.

15. The pressure regulator of claim 2, wherein said bights each have an apex and said bow spring is affixed at said apices to said side plates.

16. The pressure regulator of claim 15, wherein said bow spring is affixed to said side plates by spot welding.

17. The pressure regulator of claim 2, wherein said plates and said spring are formed from a single piece of material.

18. The pressure regulator of claim 17, wherein said material is stainless steel.

19. A thermal ink jet printer ink cartridge comprising a rigid housing containing an ink reservoir to be maintained under negative pressure, said reservoir having at least one flexible wall and an ink pressure regulator in said ink reservoir, said regulator comprising:

a) a pair of spaced substantially parallel flat side plates, one of which is engaged with said flexible wall of said reservoir; and b) a bow spring for maintaining said ink reservoir under negative pressure, said bow spring having a pair of opposed bights in contact with said plates, disposed between said plates and urging said plates apart from each other, whereby said plates and said spring occupy an essentially flat configuration as said reservoir is evacuated of ink.

* * * * *